US007950762B2

(12) United States Patent
Fujimoto

(10) Patent No.: US 7,950,762 B2
(45) Date of Patent: May 31, 2011

(54) RECORDING APPARATUS

(75) Inventor: Kazushi Fujimoto, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/698,544

(22) Filed: Feb. 2, 2010

(65) Prior Publication Data

US 2010/0225687 A1 Sep. 9, 2010

Related U.S. Application Data

(62) Division of application No. 11/697,986, filed on Apr. 9, 2007, now Pat. No. 7,686,411.

(30) Foreign Application Priority Data

Apr. 14, 2006 (JP) ..... 2006-112455

(51) Int. Cl.
*B41J 29/38* (2006.01)

(52) U.S. Cl. ..... 347/12; 347/15; 347/40; 347/43; 347/9

(58) Field of Classification Search ..... 347/12, 347/15

See application file for complete search history.

(56) References Cited

U.S. PATENT DOCUMENTS 7,168,775 B2 * 1/2007 Kuruma et al. ..... 347/14

FOREIGN PATENT DOCUMENTS

JP 7-323610 A 12/1995
JP 8-72245 A 3/1996

* cited by examiner

*Primary Examiner* — Matthew Luu
*Assistant Examiner* — Brian J Goldberg
(74) *Attorney, Agent, or Firm* — Fitzpatrick, Cella, Harper & Scinto

(57) ABSTRACT

A recording apparatus for effecting recording by scanningly moving a recording head, wherein the apparatus is provided with a group of a plurality of arrays each including a plurality of nozzles, wherein the group is responsive to one-color recording data, includes selecting means for selecting a block of a predetermined number of the nozzles in the nozzle array in synchronism with cyclic signals; driving means for driving the nozzles in the block selected by the selecting means; managing means for managing information of the block selected by the selecting means, for each group of the nozzle arrays; generating means for generating, for each nozzle array, driving data including information indicative of a block to be selected by the selecting means and block data corresponding to the block, on the basis of the information of the block managed by the managing means; and transfer means for transferring the driving data generated by the generating means to the recording head.

4 Claims, 14 Drawing Sheets

(A)

(B)

RECORDING APPARATUS

The present application is a divisional of U.S. patent application Ser. No. 11/697,986 filed Apr. 9, 2007, the entire disclosure of which is incorporated by reference herein.

FIELD OF THE INVENTION AND RELATED ART

The present invention relates to a recording apparatus which records with the use of a recording head characterized in that it is provided with multiple columns of nozzles controllable according to the recording data for each of the colors in which it is capable of recording. The present invention also relates to a method for controlling such a recording apparatus.

A printer has been widely used as an information outputting apparatus for a personal computer, facsimile machine, etc.

There have been known various recording methods for a printer. In recent years, however, an ink jet recording method has been attracting a large amount of attention, for various reasons such as it can record with no contact between a recording head and recording medium such as sheet of paper, can be easily devised to record in color, is quiet, etc.

Among various ink jet printers, an ink jet printer of the serial type, which records by moving its recording head (from which it jets ink), in the direction perpendicular to the direction in which recording medium is conveyed, has come to be widely used, because it is inexpensive and small.

One of the methods for driving the nozzles of a recording head of an ink jet printer of the serial type is described in Japanese Laid-open Patent Application 7-323610. According to this method, a large number of nozzles of the recording head are divided into multiple blocks, which can be individually driven (which hereafter may be referred to as "block-based driving method").

The nozzles of this recording head are arranged in the direction perpendicular to the direction in which the recording head is moved in a manner to scan recording medium when recording an image on the recording medium. According to this "block-based driving method", multiple nozzles of each nozzle column are organized into multiple nozzle blocks, each of which has a preset number of nozzles (each nozzle is assigned to one of nozzle blocks), and can be individually driven. For example, the nozzles of each nozzle column are organized into multiple groups (blocks) so that each group has eight nozzles. In this case, the eight nozzles which belong to the same group are simultaneously driven. Thus, in the case of a nozzle column having 128 nozzles, it has 16 groups of nozzles.

As described above, the multiple nozzles of each nozzle column are organized into multiple units, which are individually drivable. In a recording operation, the multiple units are sequentially (individually) driven with a preset timing while the recording head is traversing recording medium.

Further, according to the "block-based recording method" stated in Japanese Laid-open Patent Application 8-72245, it is presumed that all the blocks of each nozzle column are driven, and in order to raise the level of quality at which recording is made, the recording head is driven so that it does not occur that adjacent two recording elements are sequentially driven.

A "block-based driving method" in accordance with the prior art, such as the above described one, suffers from various problems, which will be described next.

To begin with, an increase in the number of nozzles in a nozzle column increases the length of time necessary to drive all the blocks in each nozzle column per scan, making it difficult to increase recording speed.

On the other hand, it is also desired to improve in durability the recording head with which a recording apparatus is provided.

From the standpoint of the durability, it is possible to employ a recording head having multiple nozzle columns per color, and record by selectively using the nozzle blocks in each nozzle column. In this case, all the nozzle blocks in each nozzle column are not used; half the nozzle blocks, for example, are used. Therefore, the length of driving time necessary per nozzle column may be expected to be shorter.

However, this arrangement is also problematic in that it requires an increase in the number of nozzle columns, and also, the number of circuits for controlling the process of driving the nozzle blocks.

Further, a recording apparatus is often used to record on various recording media other than the ordinary recording medium; there are various recording media, for example, coated paper, glossy paper, special purpose paper, etc., in addition to the ordinary recording paper.

Moreover, some recording apparatuses are enabled to operate in a mode which prioritizes speed, a mode which prioritizes image quality, etc., while using the same recording medium. In other words, a recording apparatus is desired to be able to deal with various user demands.

Thus, in order to solve the above described problems, various "block-based driving methods" (for example, in what manner nozzles are organized into blocks) have been developed to deal with various recording media, recording modes, etc.

In the case of the "block-based driving method", in accordance with the prior art, for a recording head, the nozzle blocks are driven in the preset order. Further, it is limited in the number of the recording head driving methods, from which an optimal method can be selected, and also, in the number of the recording patterns, from which an optimal pattern can be selected.

In recent years, however, it has become necessary to drive a recording head with the use of various "block-based driving methods". Thus, the circuit designed for controlling the block-based driving method in accordance with the prior art becomes problematic in that it has to be made more complicated and increased in size to solve the above described problems.

SUMMARY OF THE INVENTION

The primary object of the present invention is to realize an innovative controlling method for driving a recording head, and a control circuit for driving a recording head, in order to solve the above described problems.

According to an aspect of the present invention, there is provided a recording apparatus for effecting recording by scanningly moving a recording head, wherein said apparatus is provided with a group of a plurality of arrays each including a plurality of nozzles, wherein said group is responsive to one-color recording data, said recording apparatus comprising selecting means for selecting a block of a predetermined number of the nozzles in said nozzle array in synchronism with cyclic signals; driving means for driving the nozzles in the block selected by said selecting means; managing means for managing information of the block selected by said selecting means, for each group of said nozzle arrays; generating means for generating, for each nozzle array, driving data including information indicative of a block to be selected by said selecting means and block data corresponding to the block, on the basis of the information of the block managed by said managing means; and transfer means for transferring the driving data generated by said generating means to said recording head.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

<Structure of Recording Apparatus>

Figure 1:
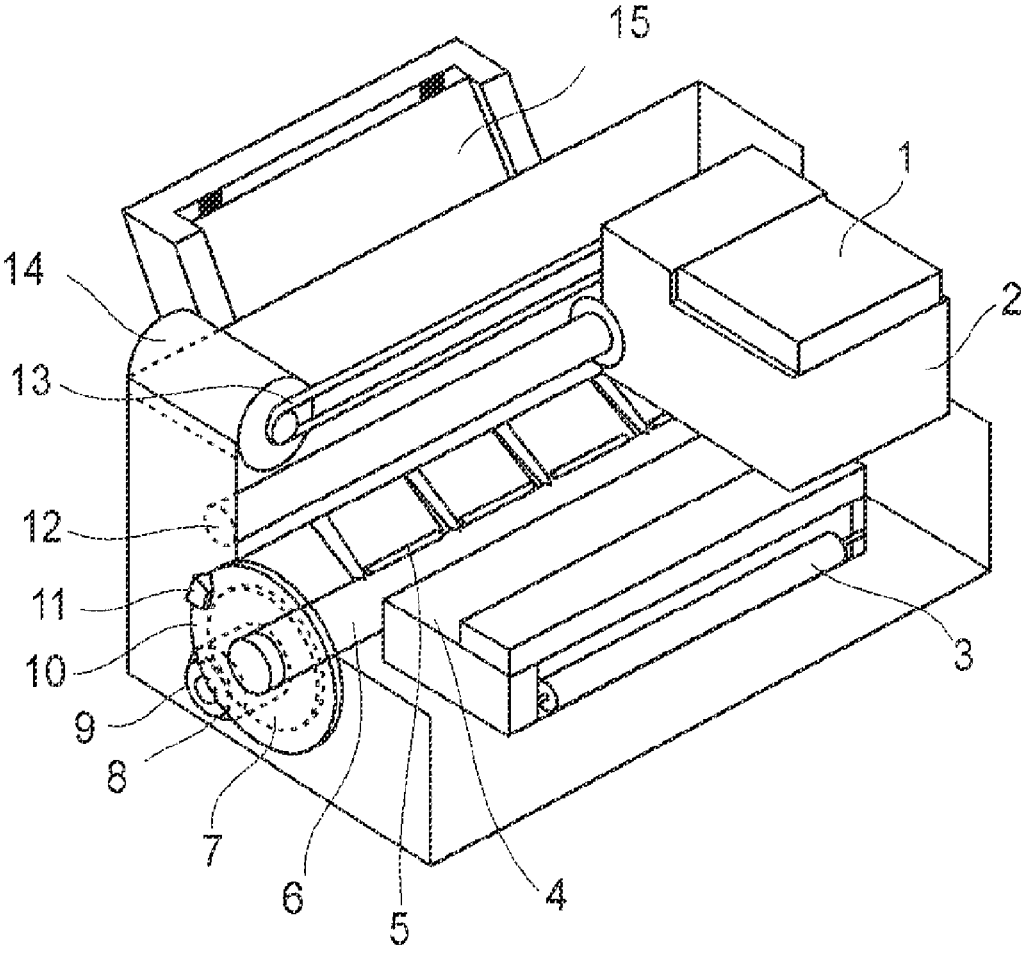
FIG. 1 is a perspective view of an example of a recording apparatus in accordance with the present invention, showing the essential structures thereof.

FIG. 1 shows the structure of a typical recording apparatus in accordance with the present invention. Designated in FIG. 1 by a referential number 1 is a recording head; 2, a carriage on which recording head is mounted; 3, a paper discharge roller, which is used when a recording medium is conveyed out of the recording apparatus after the formation of an image on the recording medium; and designated by a referential number 4 is a platen which is supporting recording medium from below.

Designated by a referential number 5 is a roller for keeping a recording paper 15 held upon the platen; 7, a paper conveyance roller gear; and designated by a referential number 8 is a paper conveyance motor for driving the paper conveyance roller 6 through the paper conveyance roller gear 7 and a paper conveyance motor gear 9. The recording paper 15 is inserted into the recording apparatus from the rear side of the apparatus, and is conveyed onto the platen 4 through the interface between the paper pressing roller 5 and paper conveyance roller 6. After an image is formed on the recording paper 15 by the ink jetted from the recording head 1, the recording paper 15 is discharged from the apparatus by the paper discharging roller 3.

Designated by a referential number 10 is an encoder film which rotates with the paper conveyance roller 6. The slits which the encoder film has are detected by an encoder sensor 11. The encoder sensor 11 outputs signals which indicate the amount of the rotation of the paper conveyance roller 6 and the peripheral velocity of the paper conveyance roller 6. These signals are used for controlling the conveyance of the recording medium 15.

Designated by a referential number 12 is a shaft which supports the carriage 2, which is driven by a carriage motor 14 through a belt 13. The carriage 2 is movable on the shaft 12 leftward or rightward. As the carriage, which is holding the recording head 1, is moved leftward or rightward, the recording head 1 is moved leftward or rightward virtually in contact with the surface of the recording medium. Thus, as the recording head 1 jets ink while being moved leftward or rightward by the carriage 2, a part of an image is effected on the recording medium.

<Structure of Control System of Recording Apparatus>

Figure 2:
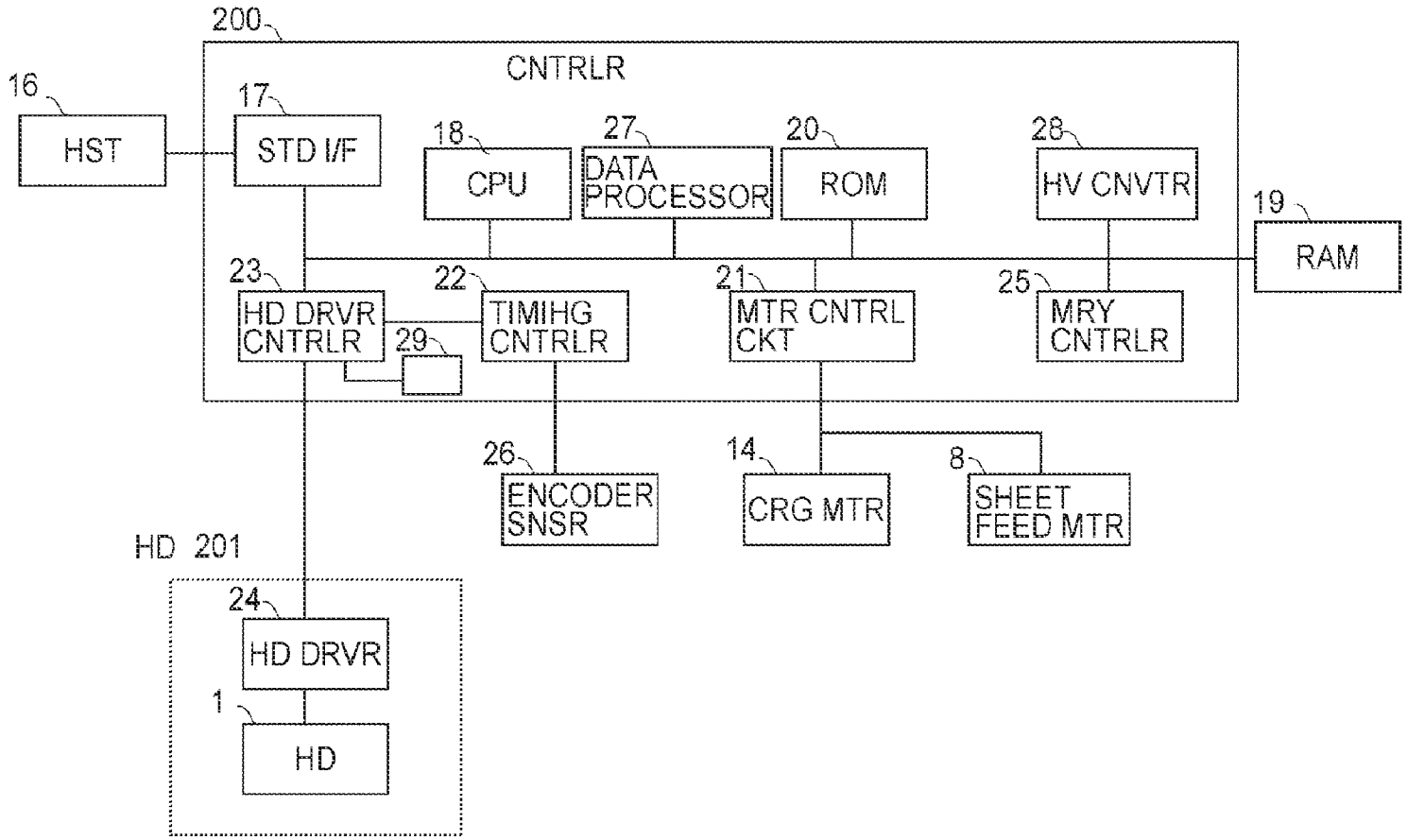
FIG. 2 is a block diagram of the control system of the recording apparatus.

FIG. 2 is a block diagram of the control system of the recording apparatus. Designated by referential number 16 in FIG. 2 is a host apparatus, and designated by a referential number 200 is the control portion of the recording apparatus, which is an ASIC, for example. This control portion 200 is provided with an interface circuit 17 (I/F circuit), a CPU 18, a ROM 20, a motor driver circuit 21, a control circuit 23 for driving recording head (which hereafter will be referred to as head driver control circuit 23), a memory control circuit 25, a data processing circuit 27, a HV conversion circuit 28, a RAM 29, etc.

To elaborate, the memory control circuit 25 controls the process of writing the index data and column data into a print buffer, or reading them therefrom. The data processing circuit 27 carries out the process of converting the index data or the like into dot data, and thinning the column data stored in the print buffer, with the use of a mask.

The memory control circuit 25 reads out the column data in synchronization with recording timing signals. The read data are transferred to the head driver control circuit 23 through the data processing circuit 27.

The HV conversion circuit 28 carries out the process of converting the raster data into columnar data.

Designated by a referential number 19 is a RAM, such as a DRAM. The RAM 19 is provided with a print buffer for storing the columnar data. It is provided with a working area used by the CPU 18, a reception buffer in which the control data and recording data received from the host 16 through the interface circuit 17 are temporarily stored.

In the ROM 20, the control programs which the CPU 18 carries out, and the control table used for controlling the head driver, motor driver, etc., are stored. The RAM 29 is a DRAM, for example. It is provided with a transfer buffer.

The motor driver circuit 21 drives the carriage motor 14, paper conveyance motor 8, and the like. Designated by a referential number 26 is an encoder sensor. A recording timing control circuit 22 generates timing signals based on the signals outputted by this encoder 26. The recording control circuit 22 generates the timing signals in response to the movement of the carriage 2 (recording head 1). Referring to FIG. 2, the signals are supplied to the head driver control circuit 23 from the recording timing control circuit 22. Incidentally, the signal wires are not shown in the drawing, in order to make it easier to comprehend the drawing. The recording timing control circuit 22 is structured so that the timing signals are also supplied to the memory control circuit 25 and data processing circuit 27.

Designated by a referential number 201 is a head portion. The head portion 201 is on the carriage. It comprises the recording head 1 and head driver 24.

Figure 3:
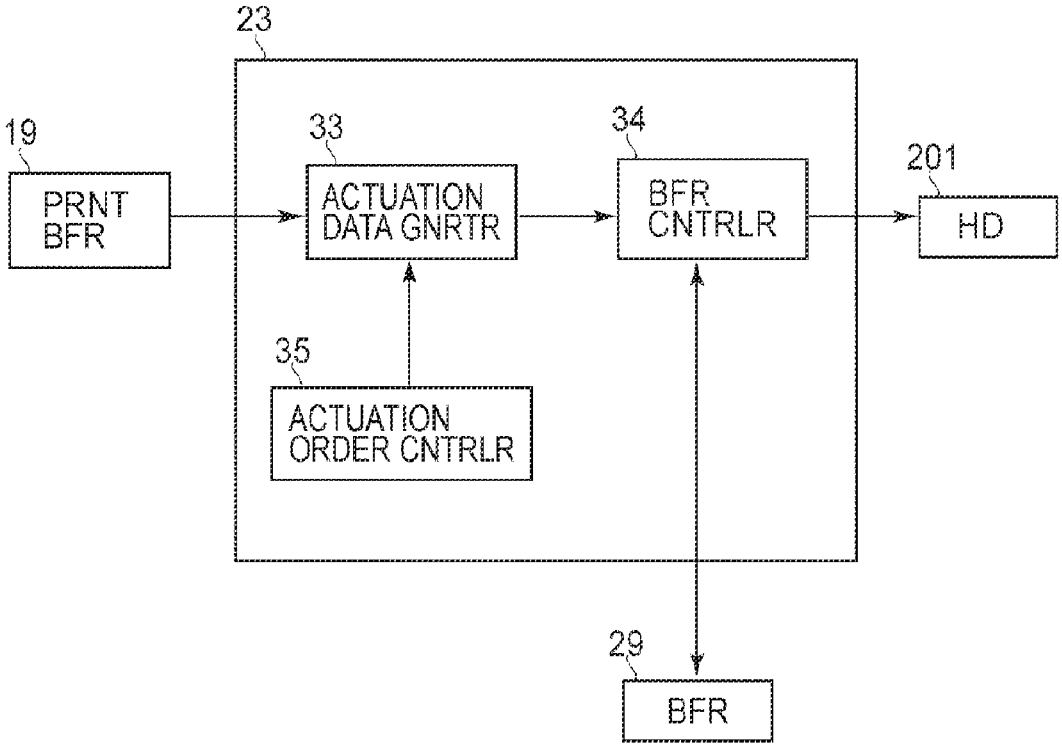
FIG. 3 is a block diagram of the head drive control circuit.

FIG. 3 is a block diagram of the head driver control circuit 23, showing the general structure thereof. The head driver control circuit 23 is provided with a driving data generating portion 33 (circuit), a driving order control circuit 35, and a transfer buffer control circuit 34.

Figure 4:
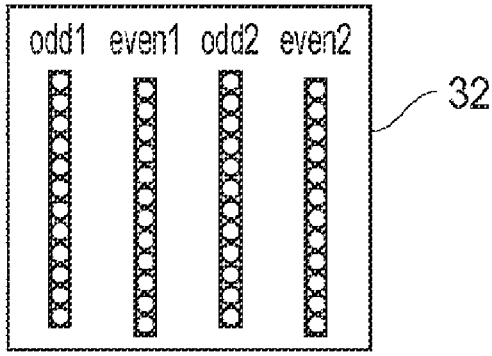
FIG. 4 is a schematic plan view of the recording head, showing the nozzle arrangement of the recording head.
Figure 4:
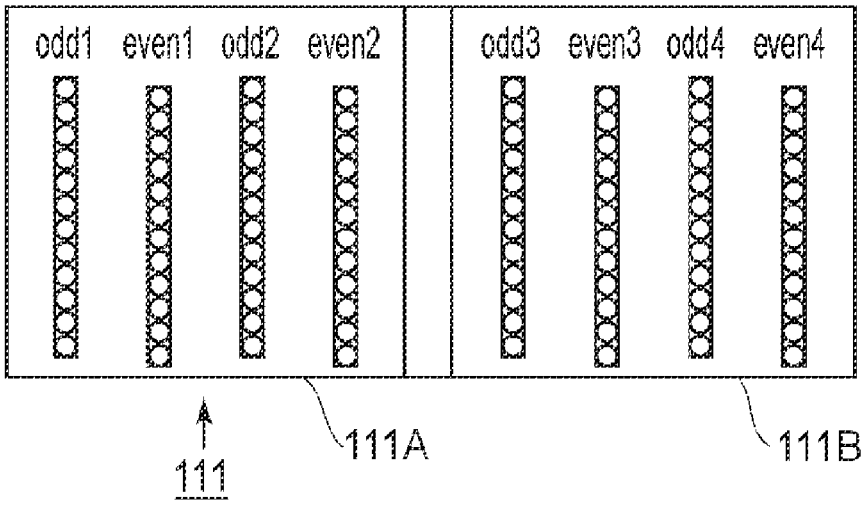

FIGS. 4(A) and 4(B) show the nozzle column arrangement of the recording head 1. The recording head shown in FIG. 4(A) has two columns of nozzles designated by odd numbers, and two columns of nozzles designated by even numbers. These columns of nozzles are juxtaposed in the direction in which the recording head 1 scans recording medium. The recording head shown in FIG. 4(B) has four columns of nozzles designated by odd numbers, and four columns of nozzles designated by even numbers. These columns are also juxtaposed in the direction in which the recording head 1 scans recording medium.

An image is completed by using the columns of odd number nozzles and the columns of even number nozzles so that the nozzles with an odd number and the nozzles with an even number complement each other. Therefore, if an attempt is made to record on the recording medium with use of only the columns of odd number nozzles, every other dot will be recorded in terms of the direction of a nozzle column.

<Description of Data in Recording Process Controlling Portion>

Figure 5:
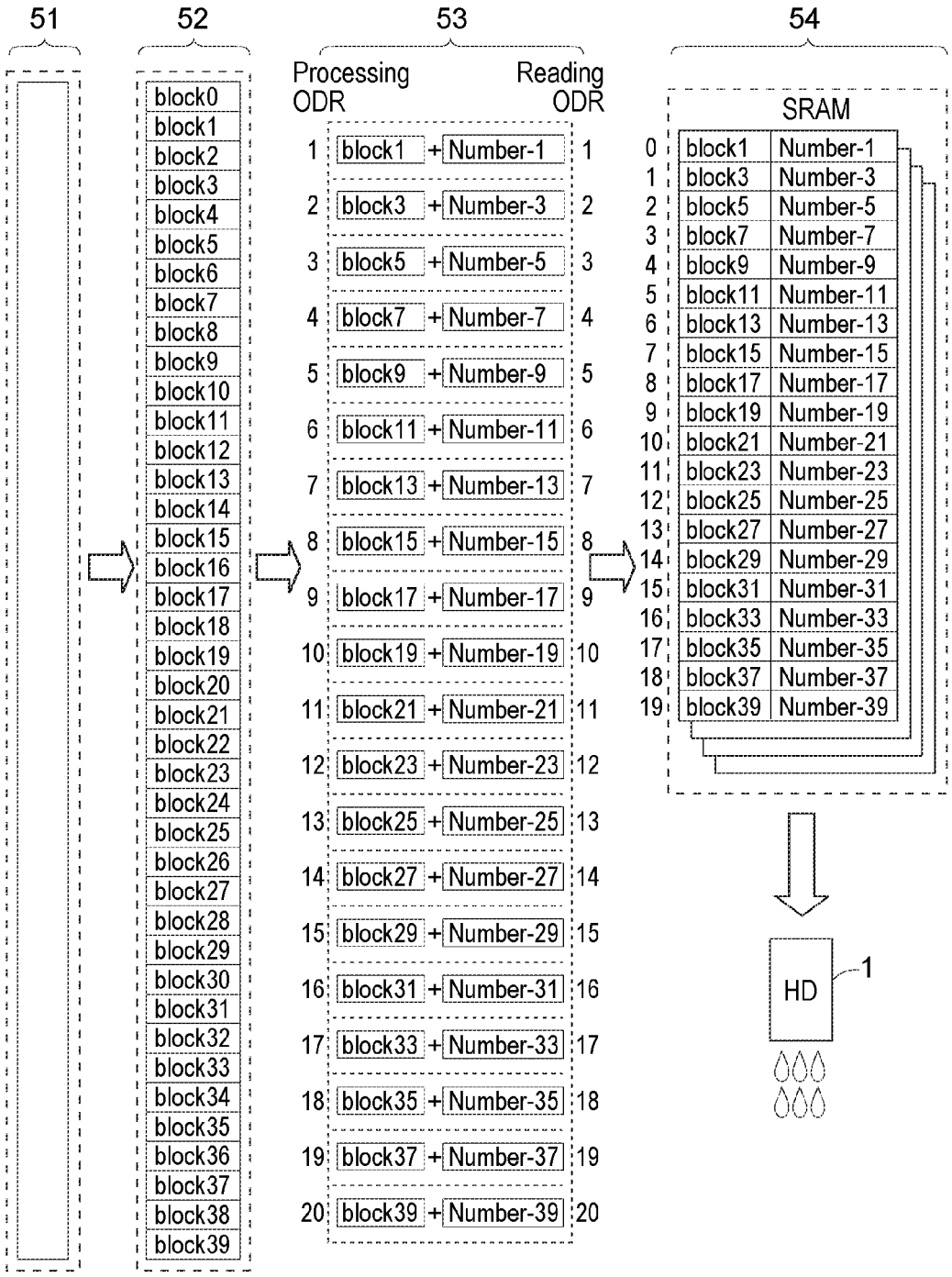
FIG. 5 is a diagram showing how recording data are processed by the control portion, in the first embodiment of the present invention.

FIG. 5 is a diagram showing the data flow in the recording process controlling portion 200. Referring to FIG. 2, in the print buffer of the RAM 27 (DRAM, for example), the columnar data 51 is stored. The memory control circuit 25 reads out from the print buffer the columnar data 51 which corresponds to one nozzle block, processes the data, and then, transfers the processed data to the head driver control circuit 23.

From this data, a block data which corresponds to a single column of nozzles is generated (converted). Incidentally, this nozzle data 51 is columnar data. For example, a block data $\mathbf{52}_{odd1}$ is generated for a nozzle column odd1.

Similarly, for a nozzle column odd2, a block data $\mathbf{52}_{odd2}$ is generated. The block data is also generated for the column of even number nozzle in the same manner as it is for the columns of odd number nozzle. The block data 52 is formatted so that it corresponds to each nozzle block. The block data 52 is generated by the number equal to the number of nozzle blocks which make up each column of nozzles. In this embodiment, 40 block data are generated.

To each block data 52, a block number (block information, or block identification information) is added, yielding a driving data 53. This driving data 53 includes dot data, the number of which corresponds to the number of nozzles in each block, and the block number. In other words, the block data 52 is converted into data which contains the data for driving the nozzles in each block, and the tag information which shows the block number.

This driving data 53 is transferred to the column of nozzles (odd1, for example) of the recording head 1. In the case of the block diagram shown in FIG. 5, the data for the top block in each nozzle column is processed first, and the data for the rest are sequentially processed. The order in which the data are processed is the same as the order in which the nozzles blocks of each nozzle column are driven.

Designated by a referential number 54 is a drawing showing the state of the driving data 53 which is in the transfer buffer to be transferred to the recording head 1. Indicated by 54 is the state in which the transfer buffer is holding driving data for 20 nozzle blocks. The capacity of this transfer buffer is enough to hold driving data 53 for three columns of nozzles, each of which requires 40 blocks worth of data.

<Description of Nozzle Block>

Figure 6:
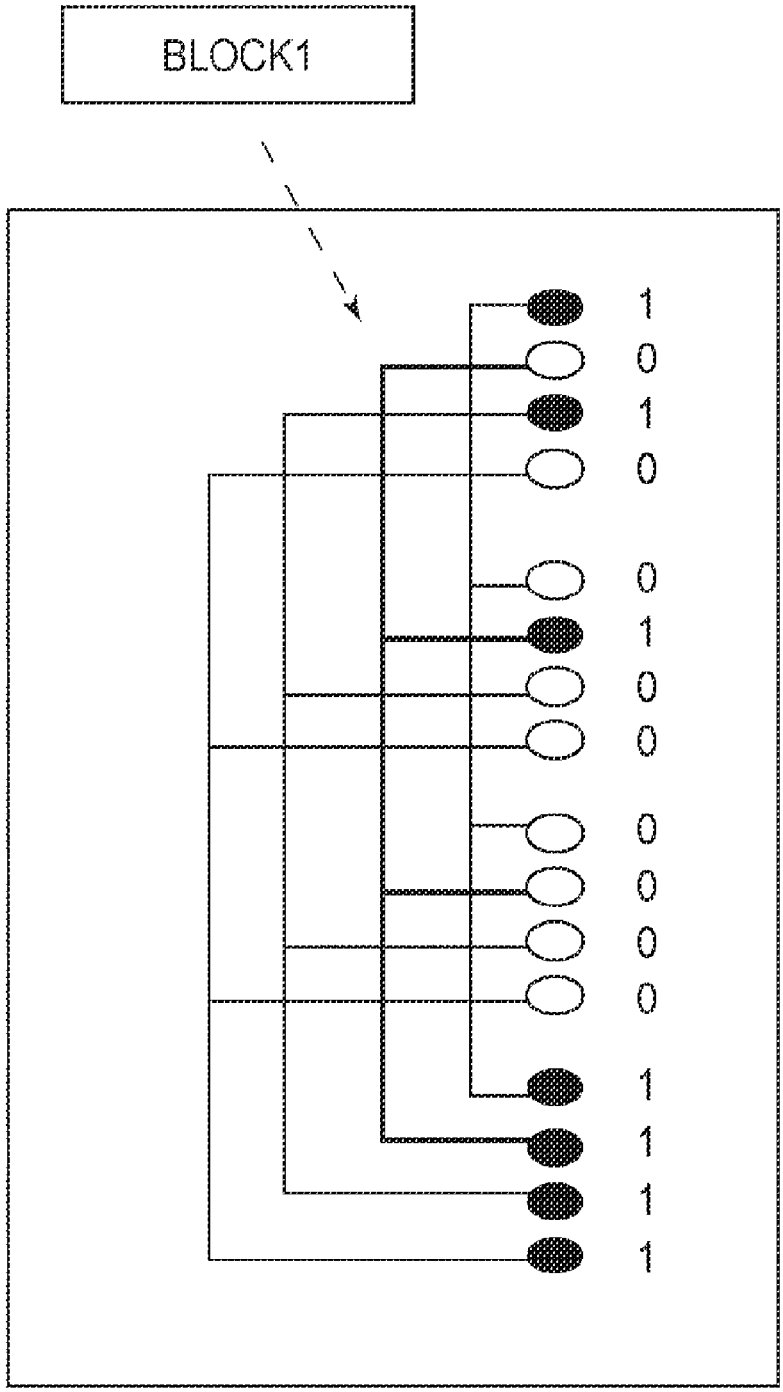
FIG. 6 is a schematic drawing showing the relationship between the recording data, and the pattern in which the nozzles are organized into multiple blocks.

FIG. 6 is a schematic drawing showing how the nozzles in each nozzle column are organized into multiple blocks. Each nozzle column (for example, odd1) is made up of multiple nozzles. In each nozzle column, the nozzles are divided (organized) into multiple blocks (groups), each of which is made up of four nozzles, which are simultaneously driven.

For example, the data for a block 1 is "0101", which hereafter will be referred to as block data. Each of the rest of blocks is organized in the same manner, yielding a data such as a data 52.

Incidentally, in order to simplify the description, the concept of the nozzle block was described with reference to the case in which one nozzle block is made up of four nozzles. However, one block may be made up of eight nozzles, or 16 nozzles. Further, one nozzle may make up one block.

As described above, the transfer buffer control circuit 34 reads out the data having a block number, which corresponds to the value in the counter of the driving order counter circuit 43, adds the block number to the data, and then, writes into (stores in) the transfer buffer 29 the combination of the data and block number in the order in which they were read out. In other words, the transfer buffer control circuit 34 converts the recording data into the combination of data and a block number tag, and then, stores the converted information into the transfer buffer 29.

As another example of block data, if each block is made up of eight nozzles, the recording data may be expressed in three bits, and the block data may be expressed in the form of three bit code. In such a case, a recording head is to be provided with a decoder circuit.

Embodiment 1

FIG. 4(A) shows the nozzle column arrangement of the recording head 1. Two odd number nozzle columns (odd1 and odd2) and two even number nozzle columns (even1 and even2) are provided per color. The four nozzle columns are selectively driven to form a single line of dots on the recording medium.

As shown in FIG. 4(A), the nozzles (indicated by circles in drawing) in each nozzle column are aligned in the direction (vertical direction in drawing: secondary scan direction) perpendicular to the direction in which the recording head 1 scans recording medium (leftward and rightward directions in drawing). The recording head 1 is set up so that a given odd number nozzle column and the even number nozzle column paired with this odd number nozzle column record the picture elements having odd ordinal numbers (counting from top side of head) and the picture elements having even ordinal numbers. In the case of the recording head 1 in the drawing, the recording head 1 is structured so that a given odd number nozzle column and the even number nozzle column paired with the given odd number nozzle column are vertically deviated relative to each other so that an imaginary line which alternately connects odd number nozzles and corresponding even number nozzles, respectively, form a zig-zag pattern. In other words, the nozzles (nozzle columns) are set up so that as picture elements are formed on recording medium by the nozzles, they slightly overlap. However, arranging the nozzles in the abovementioned zig-zag pattern is not mandatory.

The driving order counter circuit 43 of the head driver control circuit 23 extracts block data in a preset driving order. The driving data are the combination of the block data and corresponding block number. The driving data are stored in the RAM 19 (SRAM, for example) shown in FIG. 2. Incidentally, in the case of the recording head 1 shown in FIG. 4, it is in the RAM 19 that the areas which correspond to the nozzle column odd1 and nozzle column odd2 are provided.

The head driver control circuit 23 is provided with two driving order counter circuits 43. One of the driving order counter circuits 43 is used for the nozzle columns odd1 and odd2, and the other driving order circuit 43 is used for the nozzle columns even1 and even2.

Figure 7A:
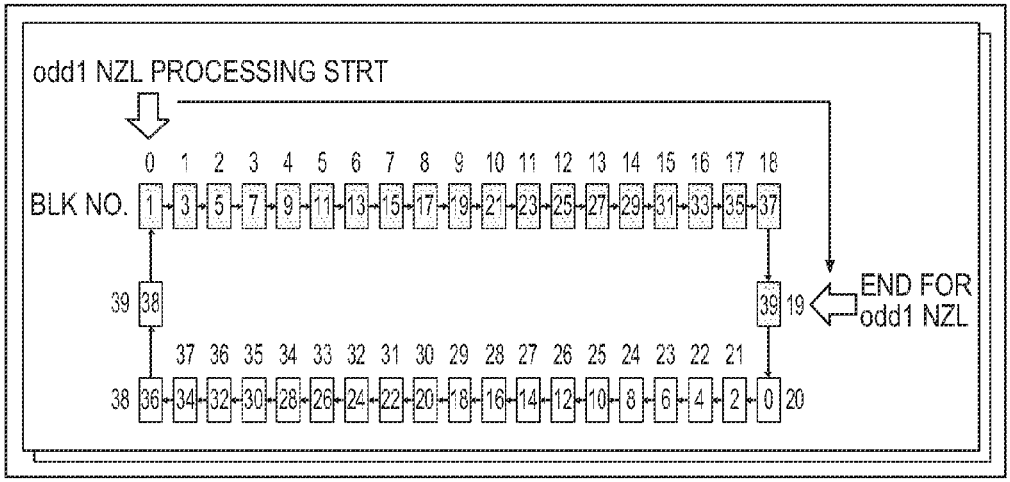
FIGS. 7A and 7B are a schematic diagram of the driving order control circuit in the first embodiment of the present invention.
Figure 7B:
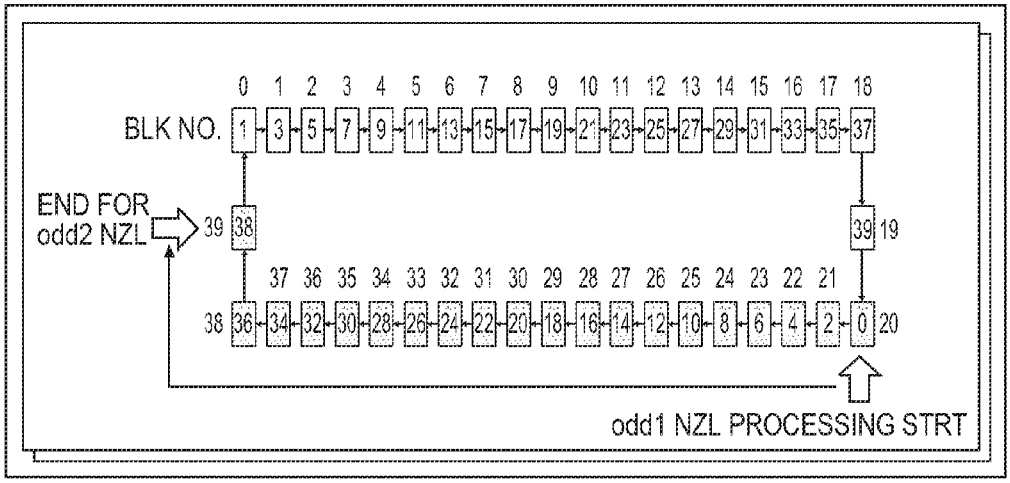

Referring to FIGS. 7A and 7B, the concept of the operation carried out by the driving order counter circuit 43 capable of selecting the blocks to be driven in the two nozzle columns (oddl and odd2) will be described. This counter circuit constitutes a table which is in the form of a ring and has 40 addresses. As shown in FIGS. 7A and 7B, the driving order counter circuit 43 is provided with a table which has addresses, the number of which correspond to the nozzle block count.

In each address, the information (block number) for specifying each block can be written. The order in which the blocks are to be driven can be set by writing a block number in each address before starting to drive the blocks.

A pointer reads out the information in each address. The read number is stored in the transfer buffer, along with the corresponding block data.

As driving begins, the pointer is sequentially moved from one address to another to read the block number in each address in order to obtain the information regarding the block which is to be driven.

The driving order counter circuit 43 is provided with a pointer P1, which is the pointer for the nozzle column odd1, and a pointer P2 which is the pointer for the nozzle column odd2. It is also provided with a register in which the starting and ending addresses for each nozzle column are stored.

As the driving begins, the control portion which controls the position of the pointer moves by one place the pointers P1 and P2 each time it drives a block of nozzles. It controls the advancement of the pointers P1 and P2 by comparing the current positions of the pointers P1 and P2 with the ending positions therefor.

FIG. 7(A) is a schematic drawing showing the forward shifting of the pointer P1, that is, the pointer for the nozzle column odd1. FIG. 7(B) is a schematic drawing showing the forward shifting of the pointer P2, that is, the pointer for the nozzle column odd2. Referring to FIG. 7(A), before starting the recording operation, the starting position for the pointer P1 is stored in Address 0, and the ending position for the pointer P1 is set in Address 19. This setup can make it possible to specify that the first block to be driven is Block 1; the second block to be driven is Block 2; the third block to be driven is Block 3; and so on, and that the last block to be driven is Block 39.

As shown in FIG. 7(A), the counter addresses 0-19 in the driving order counter circuit 43 each contain the odd numbers to be assigned to the blocks, one for one, whereas the counter addresses 20-39 each contain the even numbers to be assigned to the blocks, one for one.

Referring to 7(B), before the operation is started, the point at which the pointer P2 is to begin reading is set in Address 20 in the driving order counter circuit 43, and the point at which the pointer P2 is to end reading is set in Address 39 of the driving order counting circuit 43. With this arrangement, it can be specified that the first block to be driven is Block 0; the second block to be driven is Block 2; the third block to be driven is Block 4; and so on, and that the last block to be driven is Block 38.

To describe the pointer movement, as the first block of the nozzle column odd1 is driven, the pointer P1 advances to Address 1. Further, as the driving of the nozzle column odd2 begins, and the first block of the nozzle column odd2 is driven, the pointer P2 advances to Address 2.

The nozzle columns odd1 and odd2 are driven in synchronism with the same timing signal (block trigger signal). Thus, the pointers P1 and P2 advance to their next addresses at the same time in response to the same block trigger signal. Therefore, as the driving begins, the pointers P1 and P2 advance to their next addresses as if they were chasing each other within a single address table.

The address table is in the form of a ring. Thus, as a block trigger signal is inputted 40 times, the pointers P1 and P2 advance around the address table once.

The driving order counter circuit 43 for the nozzle columns odd1 and odd2 can also be used for controlling the nozzle columns even1 and even2. Therefore, the driving order control circuit 35 is provided with two driving order counter circuits 43. One of the two driving order counter circuits 43 is used for the nozzles columns odd1 and odd2, and the other is used for the nozzle columns even1 and even2.

<Explanation of Block Driving Timing>

Figure 8:
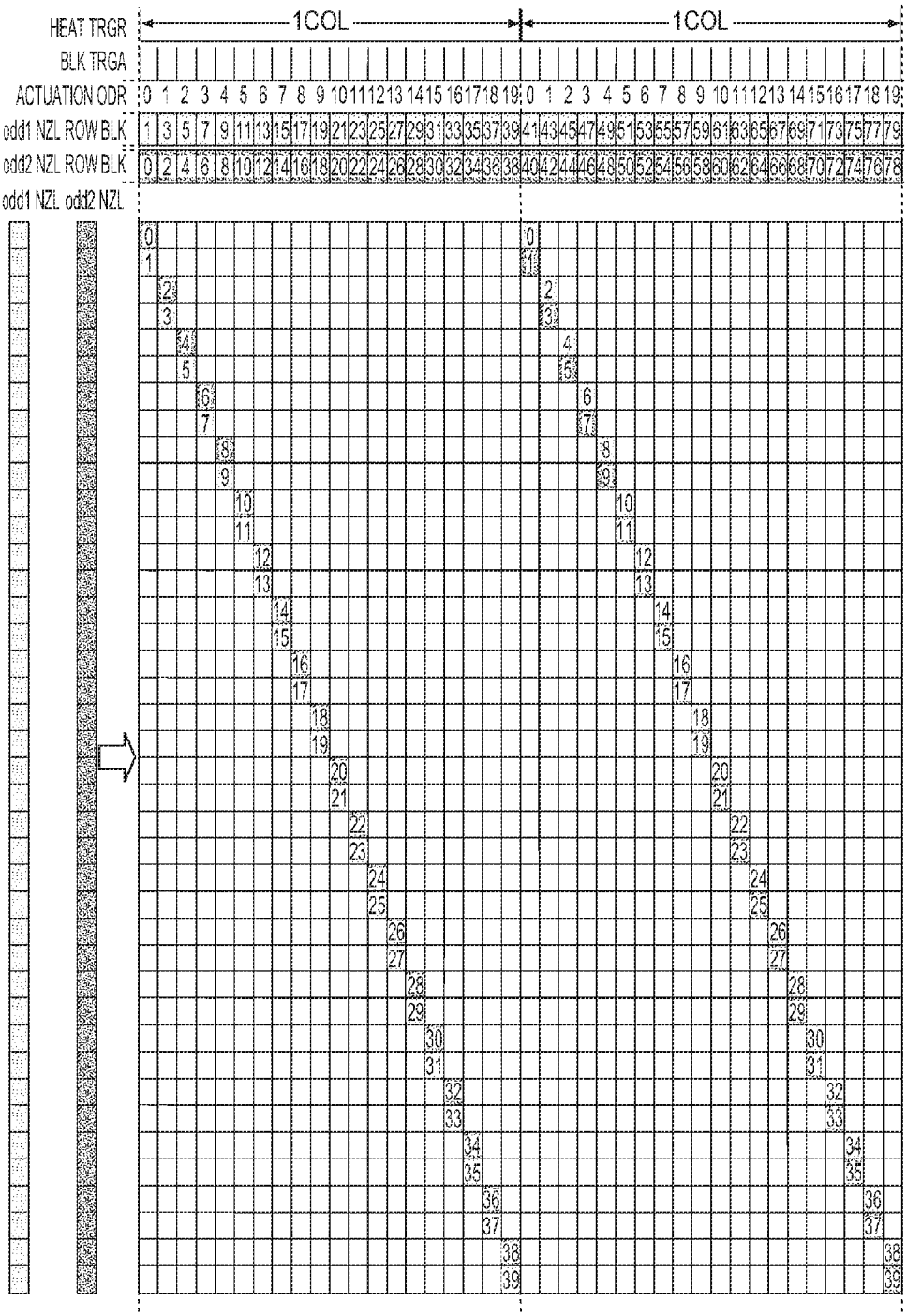
FIG. 8 is a diagram showing the timing with which each nozzle block is driven, in the first embodiment.

FIG. 8 is a diagram showing the nozzle blocks in the nozzle columns odd1 and odd2, which are driven in response to trigger signals. The horizontal axis of FIG. 8 represents elapsed time. It is to be assumed that in FIG. 8, time elapses from left to right.

The bottom portion of FIG. 8 conceptually shows the positions of the nozzle blocks in the nozzle columns odd1 and odd2, which are to be driven. In order to make it easier to visually understand the concept, FIG. 8 is drawn so that the nozzle blocks are arranged in the order of Block 0, Block 1, Block 2, and so on, listing from the most downstream side in terms of the recording medium conveyance direction. Thus, the most upstream block is Block 39.

To further describe the horizontal axis, a heat trigger signal is a signal which corresponds to a point on recording medium, which corresponds to the column position. Thus, as the heat trigger signal is outputted 20 times to drive the recording head, recording is made by the amount equivalent to 20 columns. In FIG. 8, recording is made by an amount equivalent to 20 blocks per column position.

In this embodiment, among the 40 nozzle blocks which each odd nozzle column has, 20 blocks are used per heat trigger cycle. In other words, 20 blocks of the nozzles of each of the nozzle columns odd1 and odd2 are driven per heat trigger cycle.

The order in which the nozzle blocks in the nozzle column odd1 are driven is what is set in the driving order counter circuit 43 shown in FIG. 7. That is, the nozzle blocks having an odd number, or Blocks 1, 3, 5, and so on, are sequentially driven in synchronization with the generation timing of the first heat trigger signal. Then, in synchronization with the generation timing of the next heat trigger signal, the blocks having an even number, which are Blocks 0, 2, 4, and so on, are sequentially driven. Then, in synchronization with the generation timing of the next heat trigger signal, the blocks having an odd number, which are Blocks 1, 3, 5, and so on, are sequentially driven.

As described above, in the case of the first nozzle column, the nozzle blocks having an odd number are driven, and in the case of the second column, the blocks having an even number are driven. In the case of the third column, the blocks having an odd number are driven, and in the case of the fourth column, the blocks having an even ordinal number are driven. Also in the case of the columns whose nozzles are to be subsequently driven, their nozzles blocks are to be driven in the same manner.

To further describe the movement of the pointers P1 and P2, as the heat trigger signal is inputted twice, the pointers P1 and P2 make a full round of the address table in the driving order counter circuit 43.

The nozzle blocks of the nozzle column odd2 are also driven in the order set in the driving order counter circuit 43 as shown in FIG. 7.

To elaborate, the number of the pointers matches the number of the nozzle columns with which a recording head is provided. In this embodiment, two columns of nozzles are used as the columns of the odd number nozzles. Therefore, two pointers are used. This arrangement is the same for the columns of the even number nozzles. In the case of the second embodiment which will be described later, four columns of nozzles are used as the columns of the odd number nozzles. Therefore, four pointers are employed. The arrangement for the columns used as the columns of even number nozzles is the same as that for the columns used as the columns of the odd number nozzles.

As described above, in this embodiment, the nozzles of the recording head are grouped into four columns (two columns of odd number nozzles, and two columns of even number nozzles), and in each column, the nozzles are organized into 40 blocks. Thus, a single line (column) of dots can be formed on the recording surface by scanning only once the recording surface with the recording head while sequentially driving one half of all the nozzle blocks of each nozzle column.

Paying attention to each nozzle of the recording head 1, every other column is driven. Thus, the frequency with which each nozzle is used is halved, and the nozzles become even in the frequency with which they are used. Further, not only does this method improve the recording head in scanning speed, but also, it extends the expected life span of the recording head.

Needless to say, also in this embodiment, the nozzle columns odd1 and odd2 and the nozzle columns even1 and even2 are different in position in terms of the direction in which the recording head is moved in a manner to scan recording medium. Therefore, the recording head is controlled so that the recording dots which are formed by each column of nozzles form a straight line on recording medium. In other words, the recording medium scanning speed of the recording head, the timing with which a block trigger signal is generated, and the timing with which a heat trigger signal is generate, are controlled to ensure that the abovementioned recording dots form a straight line on recording medium.

With the employment of the above described structural arrangement, the recording head can be controlled with the use of a simple and small circuit, in terms of the order in which the nozzle blocks in each of the multiple nozzle columns are to be driven.

Modified Version of Embodiment 1

In the first embodiment described above, odd numbers are assigned to the nozzles blocks in the nozzles column odd1, and even numbers are assigned to the nozzles blocks in the nozzle column odd2. In reality, all that is necessary is that the nozzles in the nozzle column odd1 and the nozzles in the nozzle column odd2 are driven in a manner to complement each other. Thus, the manner in which the nozzles in the nozzle columns odd1 and odd2 are organized in multiple blocks does not need to be limited to the above described one, as long as the nozzles in nozzle column odd1 and the nozzles in the nozzle column odd2 can be driven in a manner to complement each other.

Further, the driving order which is set for the columns odd1 and odd2 to drive the nozzle blocks thereof may be different from that for the columns even1 and even2.

Further, the nozzle driving orders set for the nozzle columns odd1 and odd2, and the nozzle driving order set for the nozzle columns even1 and even2, may be changed each time the driving order table is scanned.

In the case of a recording apparatus provided with multiple operational modes, each operational mode may be different from the other in the order in which the nozzles blocks in the columns odd1 and odd2 are driven, or the order in which the nozzles blocks in the columns even1 and even2 are driven.

Embodiment 2

FIG. 4(B) shows the nozzle arrangement of the recording head 1, which is different from the one shown in FIG. 4(A). In this case, four nozzle columns (odd1, odd2, odd3, and odd4) of nozzles having an odd number are provided per color, and also, four nozzle columns (even1, even2, even3, and even4) of nozzles having an even number are provided per color.

A single line of dots can be formed on recording medium by selectively driving these eight nozzle columns.

This embodiment is different from the first one in the number of the nozzles columns of the recording head. Otherwise, this embodiment is the same as the first one in terms of recording head structure. Thus, the structure of the recording head in this embodiment will not be described.

Figure 9:
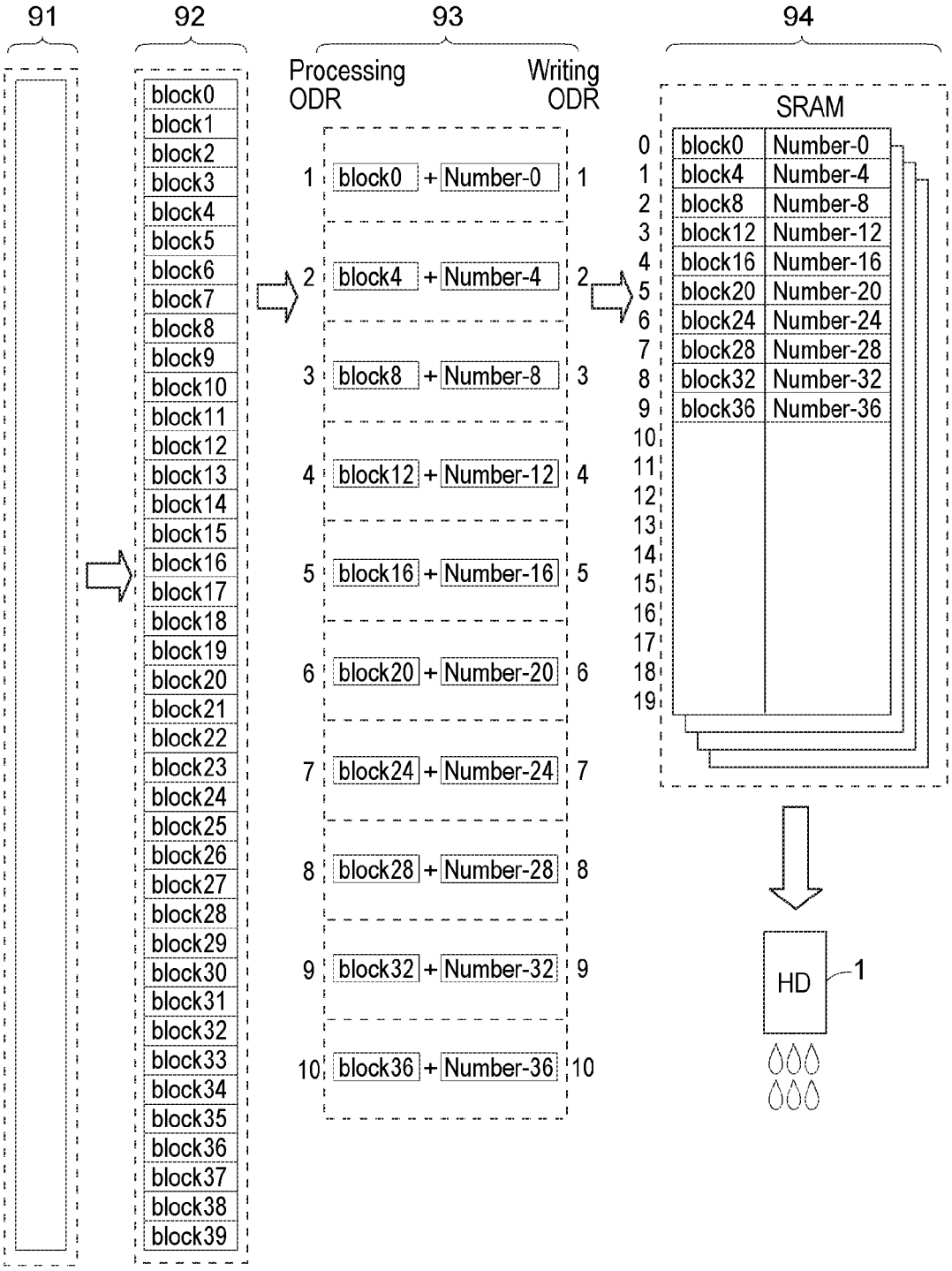
FIG. 9 is a diagram showing how recording data are processed by the control portion, in the second embodiment.

FIG. 9 is a schematic drawing, which is similar to FIG. 5 which was used to describe the first embodiment.

A nozzle data 91 is the same as the nozzle data 51. A block data 92 is the same as the block data 52. The driving data 93 is the same as the driving data 53. Therefore, the driving data will not be described.

To describe the second embodiment with reference to FIG. 9, the second embodiment is different from the first embodiment in that the number of the blocks into which the nozzles in each column are organized in this embodiment is 10. Thus, the number of driving data to be generated in this embodiment is 10, and the number of the data stored in the transfer buffer is also 10.

FIGS. 10A, 10B, 10C and 10D are a schematic drawing of the driving order counter circuit 43, which is similar to FIGS. 7A and 7B, which was used for describing the first embodiment. FIGS. 10A, 10B, 10C and 10D show the driving order counter circuit for the columns of the nozzles having an odd number.

In this embodiment, among 40 nozzle blocks in each nozzle column, 10 blocks are used per heat trigger cycle. In other words, 10 nozzle blocks in each of the four nozzle columns odd1, odd2, odd3, and odd4 are driven per heat trigger cycle.

The manner in which the nozzle blocks in each of the nozzle columns even1-even4 are driven is the same as that in which the nozzle blocks in each of the four nozzle columns odd1-odd4 are driven. Therefore, it will not be described.

In the counter addresses shown in FIGS. 10A, 10B, 10C and 10D, the block number 0, 4, 8, 12, 16 ... are sequentially stored one for one.

In this embodiment, in order to control the four nozzle columns of the nozzles having an odd number, four pointers P1, P2, P3, and P4 are employed. The pointer P1 controls the nozzle column odd1, and the pointer P2 controls the nozzle column odd2. The pointer P3 controls the nozzle column odd3, and the pointer P4 controls the nozzle column odd4.

In the driving order counter circuit 43, the point at which the pointer is to start reading and the point at which the pointer is to end reading, are set up before the start of the operation.

Figure 10A:
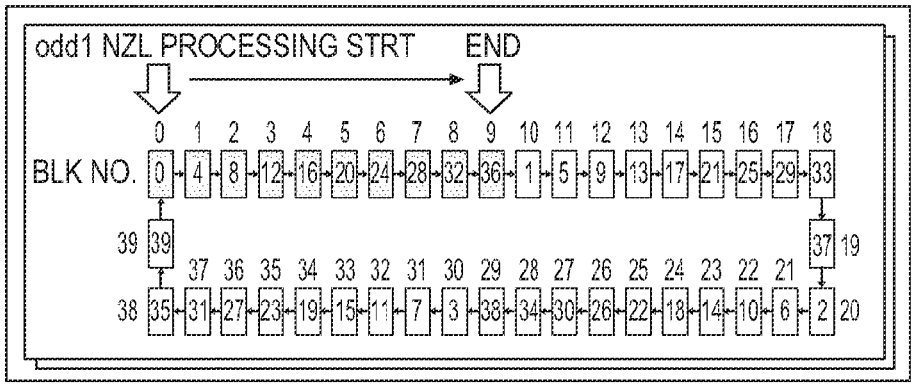
FIGS. 10A, 10B, 10C and 10D are a schematic diagram of the driving order control circuit in the second embodiment.

For example, referring to FIG. 10(A), the first and last positions of the counter which the pointer P1 is to read are stored in Addresses 0 and 9, respectively. Thus, it is possible to specify that the first nozzle block to be driven is Block 1; the second nozzle block to be driven is Block 3; the third nozzle block to be driven is Block 5; . . . ; and the last nozzle block to be driven is Block 36.

Figure 10B:
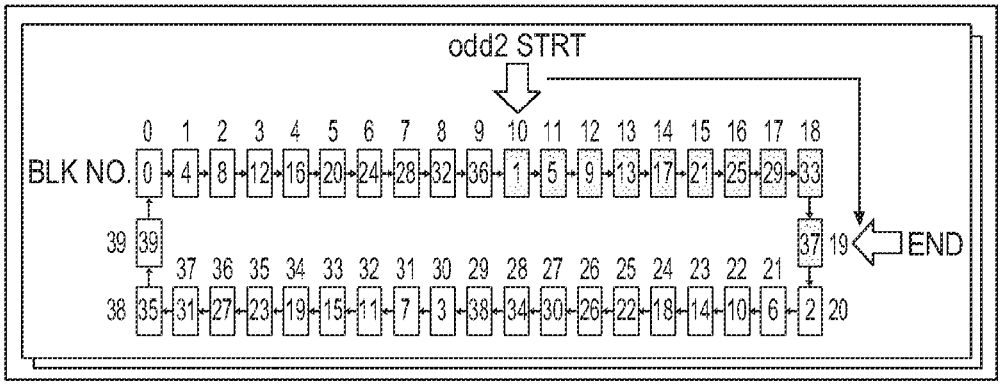
Figure 10C:
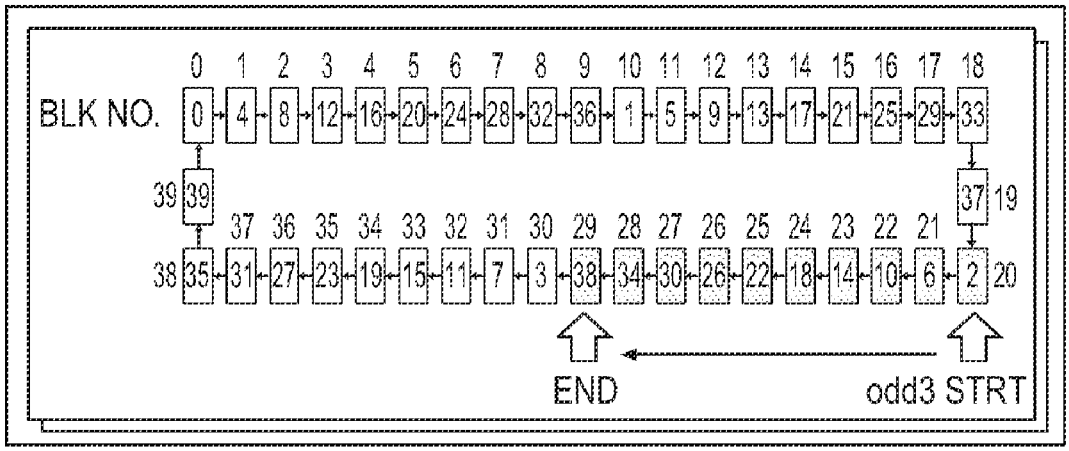
Figure 10D:
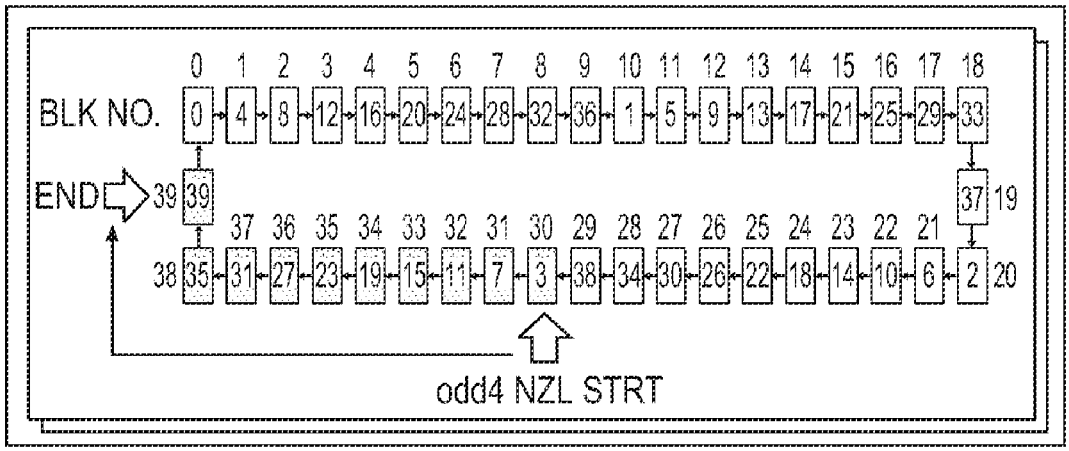
Figure 11:
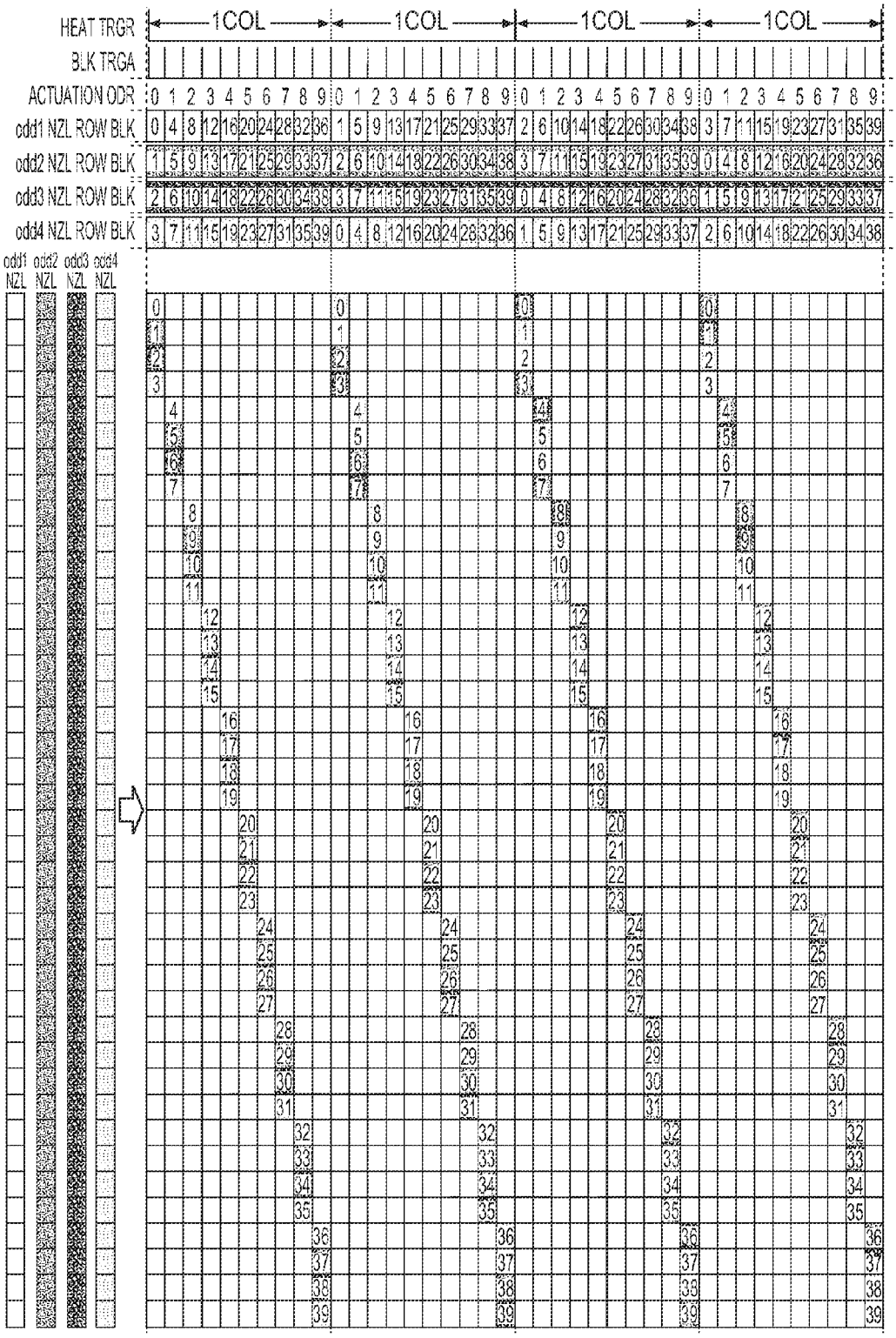
FIG. 11 is a diagram showing the timing with which each nozzle block is driven, in the second embodiment.

The driving order table for the pointers P2, P3, and P4 are shown in FIGS. 10(B), 10(C), and 10(D), respectively. The same setup as the one made for the pointer P1 are set up for the pointers P2, P3, and P4.

Therefore, in the first heat trigger cycle, the pointer P1 starts at Counter Address 0 and finishes at Counter Address 9. The pointer P2 starts at Counter Address 10 and finishes at Counter Address 19. The pointer P3 starts at Counter Address 20 and finishes at Counter Address 29. The pointer P4 starts at Counter Address 30 and finishes at Counter Address 39.

In the next heat trigger cycle, the pointer P1 starts at Counter Address 10 and finishes at Counter Address 19. The pointer P2 starts at Counter Address 20 and finishes at Counter Address 29. The pointer P3 starts at Counter Address 30 and finishes at Counter Address 39. The pointer P4 starts at Counter Address 0 and finishes at Counter Address 9.

As described above, in a recording operation, the nozzle blocks in the nozzle column odd1 are sequentially driven in the order of Blocks 0, 4, 8, . . . 36, and the nozzle blocks in the nozzle column odd2 are sequentially driven in the order of Blocks 1, 5, 9, . . . 37. The nozzle blocks in the nozzle column odd3 are sequentially driven in the order of Blocks 2, 6, 10, . . . 38, and the nozzle blocks in the nozzle column odd4 are sequentially driven in the order of Blocks 3, 7, 11, . . . 39.

The manner in which the nozzles in each of the nozzle columns even1-even4 are controlled is the same as that in which the nozzles blocks in each of the four nozzle columns of the nozzles having an odd ordinal number are controlled. Therefore, it will not be described.

In other words, a single line (column) of dots can be formed on the recording surface by scanning the recording surface with the recording head, only once per scan line, while sequentially driving ¼ of all the nozzle blocks of each of the eight nozzle columns (four nozzle columns of nozzles having an odd ordinal number, and four nozzle columns of nozzles having an even ordinal number), each of which has 40 blocks of nozzles.

Paying attention to each nozzle of the recording head 1, every fourth nozzle columns are driven, reducing thereby the frequency with which each nozzle is used, to ¼, and the nozzles become equal in the frequency with which they are used. Further, not only does this method improve the recording head in scanning speed, but also, it extends the expected life span of the recording head.

Obviously, also in this embodiment, the nozzles columns odd1, odd2, odd3, and odd4, and the nozzle columns even1, even2, even3, and even4 are different in position in terms of the direction in which the recording head is moved in a manner to scan recording medium. Therefore, the recording head is controlled so that the recording dots which are formed by each column of nozzles form a straight line on recording medium. In other words, the recording medium scanning speed of the recording head, the timing with which a block trigger signal is generated, and the timing with which a heat trigger signal is generated, are controlled to ensure that the abovementioned recording dots form a straight line on recording medium.

Modified Version of Embodiment 2

In the second embodiment described above, the four nozzle columns odd1-odd4 are made different in the block numbers allotted thereto to specify the nozzle blocks to be driven. In reality, all that is necessary is that the nozzle blocks are driven in a manner to complement each other. Thus, the manner in which the nozzles in the nozzle columns odd1-odd4 are organized in multiple blocks does not need to be limited to the above described one, as long as the blocks are driven in a manner to complement each other.

Further, the driving order which is set for the nozzle columns odd1-odd4 to drive the nozzle blocks thereof may be different from that for the nozzle columns even1-even4.

Further, the nozzle driving orders set for the nozzle columns odd1-odd4, and the nozzle driving order set for the nozzle columns even1-even4, may be changed each time the driving order table is scanned.

In the case of a recording apparatus provided with multiple operational modes, each operational mode may be different in terms of the order in which the nozzles blocks in the columns odd1-odd4 are driven, or the order in which the nozzles blocks in the columns even1-even4 are driven.

In the case of a recording head having four nozzle columns of odd1-odd4, and four nozzle columns of even1-even4, it may be provided with a mode in which the nozzle columns odd1 and odd2, and the nozzle columns even1 and even2 are used per scan.

With the employment of the above described arrangement, not only is it possible to easily control the order in which the nozzle blocks are driven, per scan, and also, to optimally set the driving order according to the operational mode.

Also with the employment of the combination of the above described hardware and software setups, the order in which the nozzle blocks are to be driven can be controlled with the use of a circuit which is substantially simpler and smaller than a circuit in accordance with the prior art, even when the nozzle columns selected from among a large number of nozzle columns are used for recording.

Control Sequences in Embodiments 1 and 2

Figure 12:
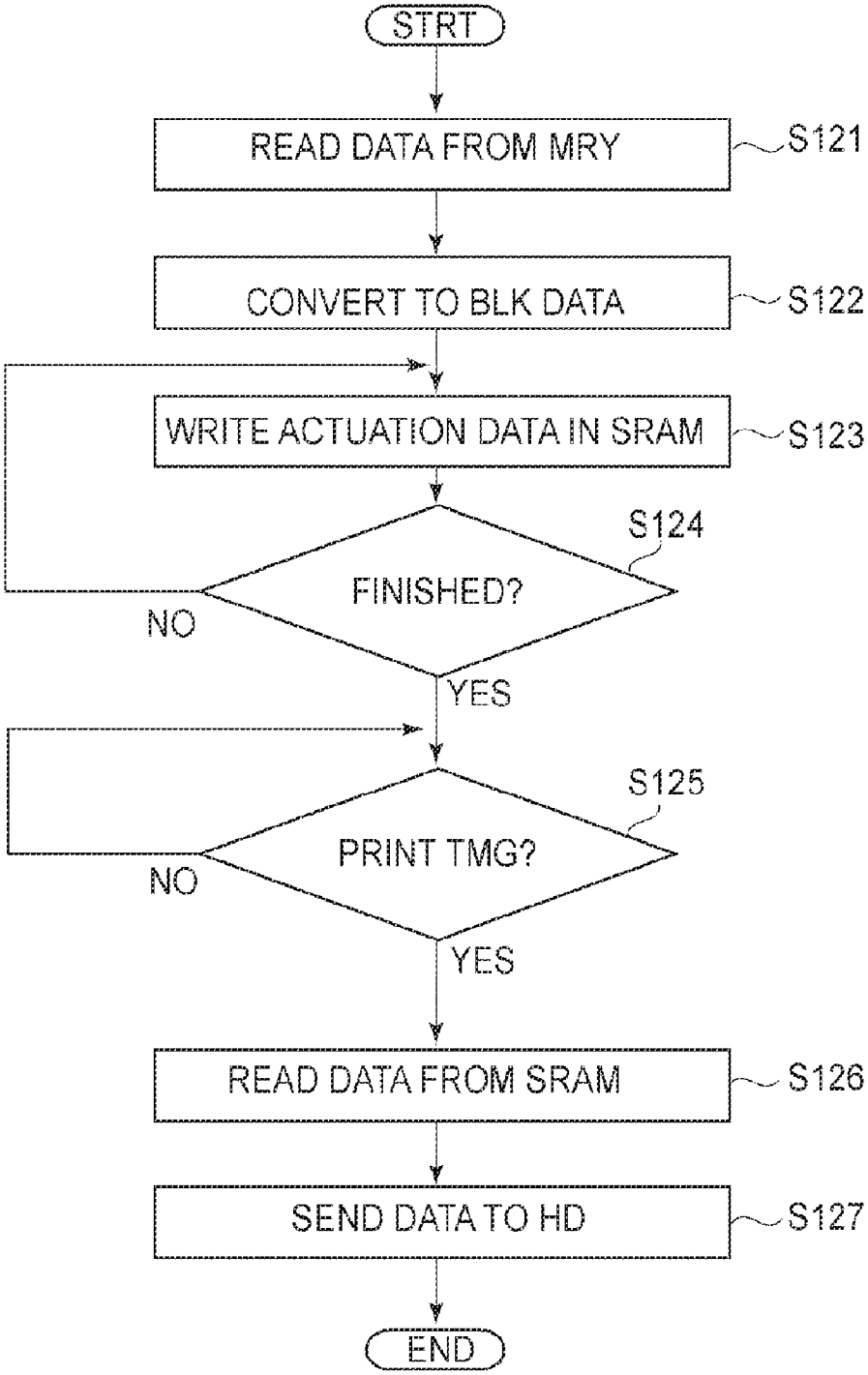
FIG. 12 is a flowchart of the driving data processing sequences in the first and second embodiments.

Next, referring to FIG. 12, the control sequences carried out by the recording process controlling portion 200 will be described. This control sequence is carried out primarily by the CPU 18. The control sequence shown in FIG. 12 is stored the ROM 12 or the like.

In Step S121, the nozzle data are read out from the print buffer. In Step S122, the nozzle data are converted into block data. In Step S123, the driving data having both the block number and block data are stored in the transfer buffer.

In Step S124, it is checked whether or not the driving data for the number of the nozzle blocks in each of the nozzle columns to be used for recording have been stored. For example, in the case of the first embodiment, it is checked whether or not the driving data for 20 nozzle blocks have been processed and stored.

In Step S125, if the answer is No, the control portion 200 returns to Step S123 and continues the sequence. If the answer is Yes, the control portion 200 advances to Step S125.

In Step S125, it is checked whether or not a recording timing signal (heat trigger signal) has been generated. If the answer is Yes, the control portion 200 advances to Step S126.

In Step S126, the drive data are read out of the transfer buffer. In Step S127, the driving data are sequentially transferred to the recording head, starting from the driving data for the first nozzle block, in synchronization with the heat trigger signal.

To elaborate, this control sequence is carried out for each of the nozzle columns to be used for recording. Therefore, the block data generating portion is provided with multiple registers, the number of which matches the number of the nozzle columns, in order to hold the block data for each nozzle column.

The number of transfer buffers 29 is also the same as that of the nozzle columns. However, there is only one transfer buffer control circuit 1, which controls the multiple transfer buffers 29.

Figure 13:
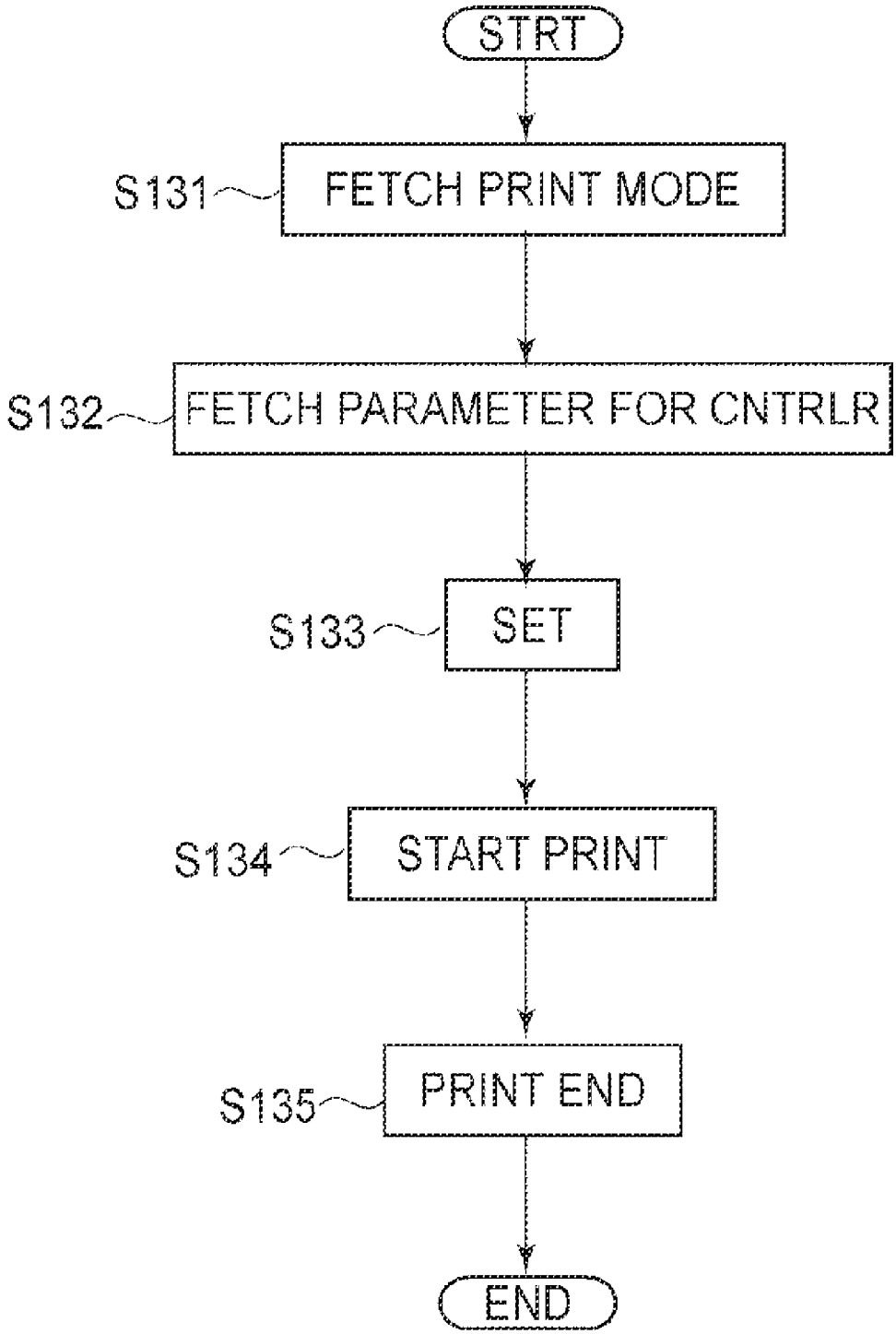
FIG. 13 is a flowchart of the operational sequence carried out by the control circuit for driving the recording head.

Next, referring to FIG. 13, the control sequence for the head driver control circuit 23 will be described. This control sequence is carried out primarily by the CPU 18. This control sequence, shown in FIG. 13, is stored in the ROM 20 or the like.

This control sequence is carried out before starting to scan the recording medium with the recording head or start a recording operation.

In Step S131, the information regarding the recording mode is obtained. An example of the recording mode information is the information regarding whether the apparatus is in the high speed mode or high quality mode. It also includes the information regarding the type of recording medium, for example, whether the recording medium is cord paper, ordinary paper, glossy paper, or the others.

It also includes information regarding whether or not the apparatus is in the multi-pass recording mode, and information regarding which line from the top (bottom) of recording medium is going to be recorded.

It also includes the number of times a block trigger is generated per heat trigger cycle, length of time of a heat trigger cycle, and scanning speed of the recording head. In other words, the driving order can be set according to information such as the above described one. Therefore, it is possible to deal with various driving methods.

In Step S132, the parameters for the driving order counter circuit are obtained based on the information regarding recording mode.

As described above, the abovementioned parameters are the parameters which are set in the driving order counter circuit 43. For example, they are the information regarding the driving order, and the starting and ending positions of the pointers. Further, there are information regarding the nozzle columns used for the current recording job, a number of nozzle blocks in each of the nozzle columns used for the current recording job, etc.

In Step S133, the information obtained in Step S132 is set in the driving order counter circuit 43.

In Step S134, the recording head is caused to begin to move in a manner to scan the recording medium to record an image on the recording medium. The process carried out in Step S133 may be carried out any time, as long as it can be completed before the recording head begins to be driven for each scan line.

In Step S135, the control sequence is ended as soon as the current recording job is completed.

Miscellaneous Embodiments

In the first and second embodiments described above, a single line (column) of dots was formed on the recording surface by scanning, only once per scan line, the recording surface with the recording head to recording on the recording surface. However, the present invention is also applicable to a case (mode) in which the recording head of which scans a given area of recording medium multiple times to form a single straight line (column) of dots.

All that is necessary to be done in this mode (multi-pass mode), in which a given area of recording medium is scanned multiple times by the recording head to form a single straight line (column) of dots is to thin the nozzle data per nozzle when reading out the nozzle data from the print buffer.

Further, in the preceding embodiments, the number of nozzle blocks in each nozzle column of the recording head was 40. However, it does not need to be limited to 40. It may be 20 or 60.

Further, the number of nozzle columns of the recording head does not need to be limited to the abovementioned value.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 112455/2006 filed Apr. 14, 2006 which is hereby incorporated by reference.

What is claimed is:

1. A recording apparatus for effecting recording by scanningly moving a recording head, wherein said apparatus is provided with a group of a plurality of arrays each including a plurality of nozzles, wherein said group is responsive to one-color recording data, said recording apparatus comprising:

selecting means for time-division drive for each of blocks of nozzles in the nozzle array in synchronism with cyclic signals.

driving means for driving the block selected by said selecting means;

a register storing a number of pieces of discriminative information corresponding to a number of blocks in the nozzle array, for each nozzle array group;

reading means for reading the discriminative information out of said register on the basis of information of an order of the blocks to be read for each in a predetermined period for each nozzle array group, information of a number of the blocks to be driven in the predetermined period and a read starting address of said register;

transfer means for transferring, to said recording head, drive information including the discriminative information read by said reading means and block data corresponding to the discriminative information; and control means for controlling said reading means and said transfer means in synchronism with the cyclic signals.

2. An apparatus according to claim 1, further comprising control means for changing the discriminative information stored in said register, for each scanning operation of said recording head.

3. An apparatus according to claim 2, wherein said recording apparatus is operable in a plurality of recording modes, said apparatus further comprising second control means for storing the discriminative information in said register on the basis of a selected mode.

4. A recording apparatus for effecting recording by scanningly moving a recording head, wherein said apparatus is provided with a group of a plurality of arrays each including a plurality of nozzles, wherein said group is responsive to one-color recording data, said recording apparatus comprising:

selecting means for time-division drive for each of blocks of nozzles in the nozzle array in synchronism with signals corresponding to column positions;

driving means for driving the block selected by said selecting means;

a register for storing, for each nozzle array group, a number of pieces of block information corresponding to a number of blocks in said nozzle array;

reading means for reading the block information out of said register on the basis of information of an order of blocks to be read in a period of the signals corresponding to the column positions for each nozzle array group, information of a number of blocks to be driven in the period and an address in said register to be first read in the period; and transfer means for transferring, to said recording head, drive information including the block information read by said reading means and a recording code corresponding to the block information.

* * * * *